United States Patent [19]

Fern

[11] 4,106,771

[45] Aug. 15, 1978

[54] GOLFER'S TRAINING DEVICE

[76] Inventor: Thomas S. Fern, 50777 Lilac Rd., South Bend, Ind. 46628

[21] Appl. No.: 761,469

[22] Filed: Jan. 21, 1977

[51] Int. Cl.[2] ..... A63B 69/36

[52] U.S. Cl. ..... 273/183 B; 46/175 R; 36/139; 273/187 R; 273/188 A

[58] Field of Search ..... 36/139; 46/175 R; 273/183 B, DIG. 18, 187 R, 187 A, 187 B, 188 R, 188 A

[56] References Cited

U.S. PATENT DOCUMENTS

| | | | |
|---|---|---|---|
| 2,721,420 | 10/1955 | Chatten | 36/139 X |
| 3,432,964 | 3/1969 | Visitacion | 46/175 R |
| 3,878,641 | 4/1975 | Noble | 36/139 X |

*Primary Examiner*—George J. Marlo
*Attorney, Agent, or Firm*—Oltsch & Knoblock

[57] ABSTRACT

A golf training device for indicating a predetermined desired shifting of the weight of a golfer during a golf stroke, wherein a member is clamped to the sole of a shoe at the instep and mounts a spring plate extending laterally from the shoe and mounting at its outer end a ground engaging member. The spring has a deformed portion intermediate its length which produces an audible signal when a predetermined flexure of the spring plate occurs incident to a change of the angular position of the shoe as a proper or desired golf stroke is nearing completion.

7 Claims, 13 Drawing Figures

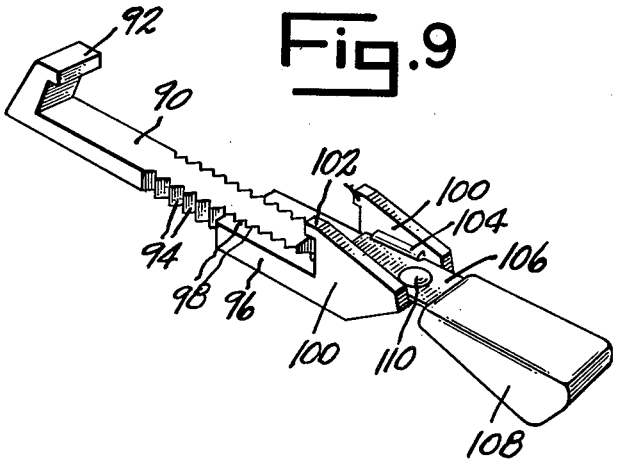
Fig. 9
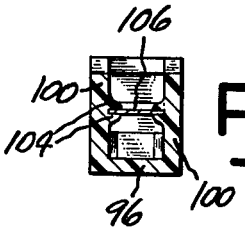
Fig. 12
Fig. 10
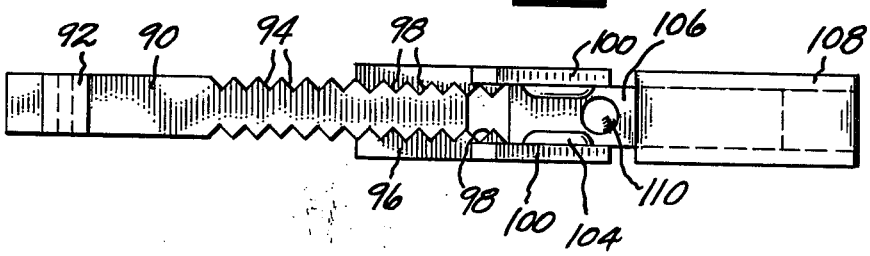
Fig. 11
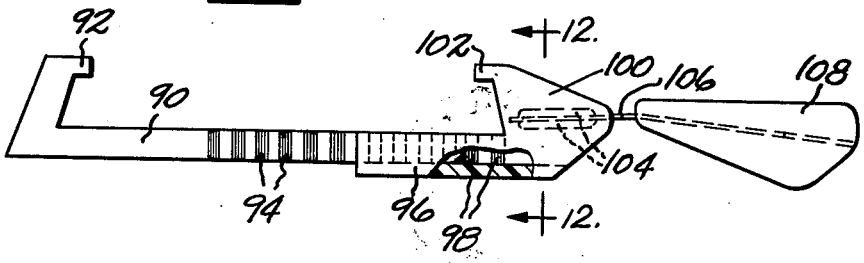
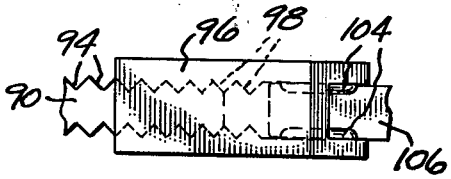
Fig. 13

GOLFER'S TRAINING DEVICE

SUMMARY OF THE INVENTION

This invention relates to improvements in golfer's training devices and more particularly to a weight shift indicator for use by golfers.

Various factors are important in playing the game of golf. Many of these factors involve or relate to the golfer's swing and the manner in which he strikes the ball. The golfer's swing in turn is influenced by a number of factors such as the position of the arms, the grip upon the club and the balance of the golfer, and the extent of the swing. Some of these factors, such as the grip, are easily regulated because they can be checked before the start of the swing. Other factors occur during the stroke while movements are rapid and difficult of visual detection even by experienced instructors. Practice to achieve a proper or effective stroke or swing is important and is widely recommended. This can be done on practice tees, or indoors where a driving net or a light weight ball can be used, or can be done without striking a practice ball, i.e. by merely going through the motion. However, practice may not be productive in the absence of some indication of the effectiveness and proper nature of the stroke or swing.

One factor involved in a golf swing is known as the follow-through and entails the manner in which the swing is completed and the position of the body and the feet incident to a change in the balance of the player which occurs during a swing. This frequently entails a change in the position of the left foot of a right handed golfer during follow-through which occurs incident to the movement and the change in body balance during a stroke. Various types of devices have been considered heretofore to assist in determination of the dynamic factors of a stroke or swing by golfers and other athletes. Thus, audible signal means of different types have been utilized as training aids for golfers and snow skiers, examples of which are seen in U.S. Pat. Nos. 3,774,572 and 3,861,688 wherein contacts or connections between a device and a body member produce an audible signal upon the occurence of certain physical conditions or positions. Some may require electrical controls and the activation of controls for operation of sound generating members. Another attempt to solve the problem is shown in U.S. Pat. No. 3,169,022 which discloses electronic means for indicating the distribution of a golfer's weight at the instant of ball impact. Another type of prior device is illustrated in U.S. Pat. No. 3,951,407 wherein an attachment to a shoe is employed to place the golfer's foot in a laterally tilted attitude during a golf stroke.

It is the primary object of this device to produce a simple, inexpensive, effective device which may be quickly applied to and removed from a golfer's shoe and used during practice to provide an indication of the effectiveness and the proper character of change occurring in the foot position of a golfer during practice swings, so that he is apprised of the nature and character of each swing with reference particularly to the follow-through and the shift of body weight during each swing.

A further object is to provide a simple and inexpensive device which can be attached quickly to the shoe of the user and which provides simple mechanical means by which a noise is produced when a desired movement of the shoe incident to a change in weight distribution occurs during a golf swing.

A further object is to provide a device of this character which can be readily adjusted to meet the requirements of users having different physical attributes, so that a given device can easily be adjusted to meet the needs of different users.

Other objects will be apparent from the following specification.

In the drawings:

FIG. 9 is a perspective view of another embodiment of the invention.

FIG. 10 is a top plan view of the device shown in FIG. 9.

FIG. 11 is a side elevational view of a device shown in FIG. 9 with parts shown in section.

FIG. 12 is a transverse sectional view taken along line 12—12 of FIG. 11.

FIG. 13 is a fragmentary bottom plan view of the device shown in FIG. 9.

DESCRIPTION OF THE PREFERRED EMBODIMENTS

Figure 1:
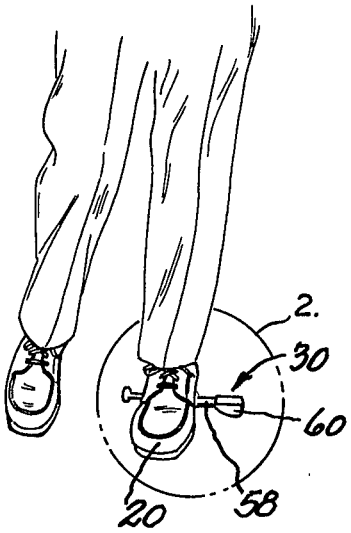
FIG. 1 is a view illustrating the manner in which the device is used by a right handed golfer.

Referring to the drawings and particularly to FIGS. 1–6 which illustrate one embodiment of the invention. The numeral 20 designates a shoe having a sole 22 and a heel 24, such as a golfing shoe which is provided with cleats 26 at the sole and heel. My new device designated 30 is applied to the sole 22 of the shoe at the instep in the position illustrated in FIG. 6.

Figure 6:
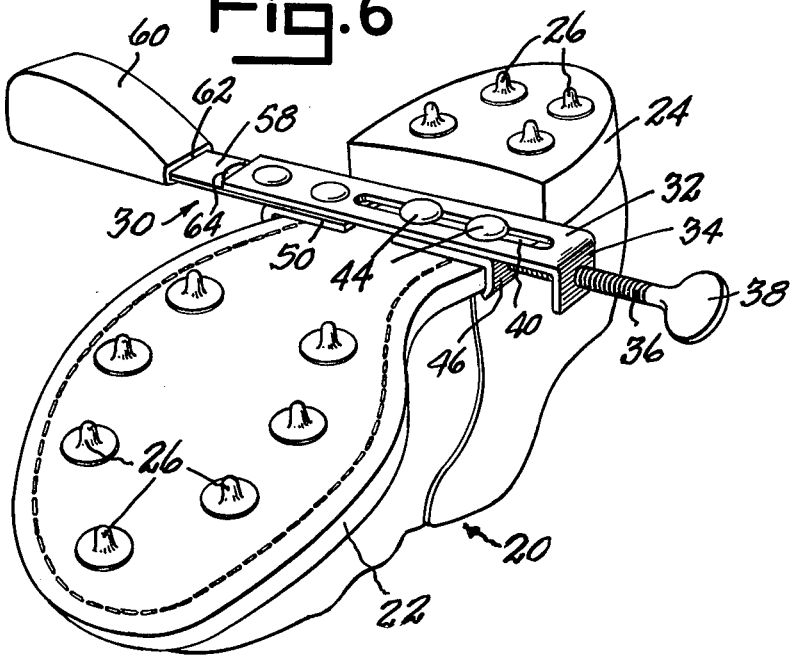
FIG. 6 is a bottom or inverted view of the device as applied to a shoe.

My new device includes an elongated substantially rigid base plate 32 which has an angularly extending end portion 34 having an aperture in which is threaded an elongated screw 36 which extends substantially parallel to and spaced above the major portion of the base plate and is provided with a hand grip portion 38. An elongated longitudinal slot 40 is formed in base plate 32 and extends from a point adjacent to the angular end part 34 to a selected point mid length of the plate 32. A clamping member is adjustable on the base plate 32 and includes a clamp base 42 slidable on the base plate 32 and carrying guide members 44 which project through and are slidable in the slot 40. The clamp member includes an upturned end part 46 which terminates in an angular flange 48 spaced above the clamp base 42 a distance substantially equal to the thickness of the sole 22 of a shoe and which extends in a direction opposite from or away from the angular end portion 34 of the base plate 32. A fixed clamp is mounted on the end of the base plate 32 opposite the end from which part 34 projects and includes a fixed clamp base 50 secured to base plate 32 as by suitable securing means such as rivets 52. The fixed clamp has an upturned end portion 54 terminating in an angular flange 56 at its upper end extending in the direction of or toward the flange 48 of the adjustable clamp. The two clamps cooperate to fixedly anchor the device to the shoe sole 22 as best seen in FIG. 6 to extend transversely of the sole forwardly of the heel of the shoe.

Figure 2:
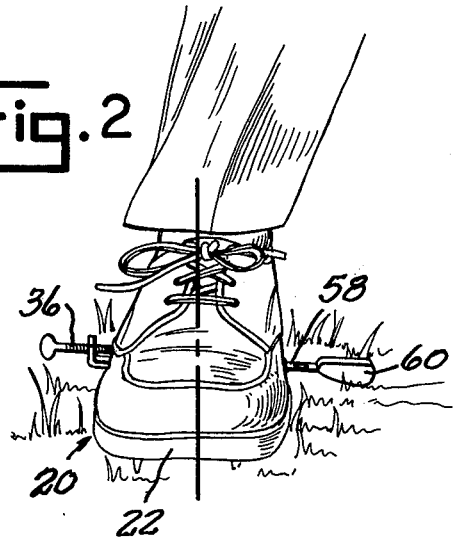
FIG. 2 is an enlarged view illustrating the application of the device to the shoe of a golfer whose foot is in one position, as during the start of a stroke or swing.
Figure 3:
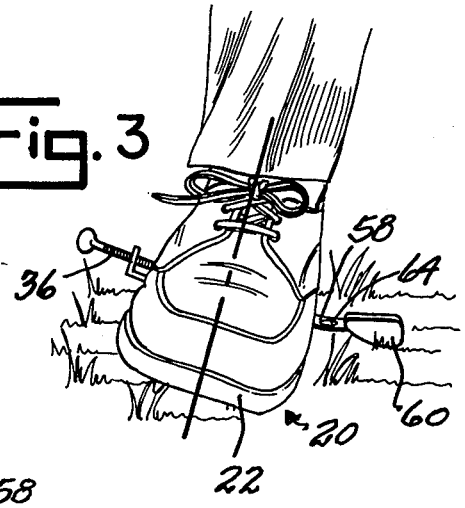
FIG. 3 is a view illustrating the application of the device to a shoe of a golfer whose foot has changed, as during the follow-through of a stroke or swing.
Figure 4:
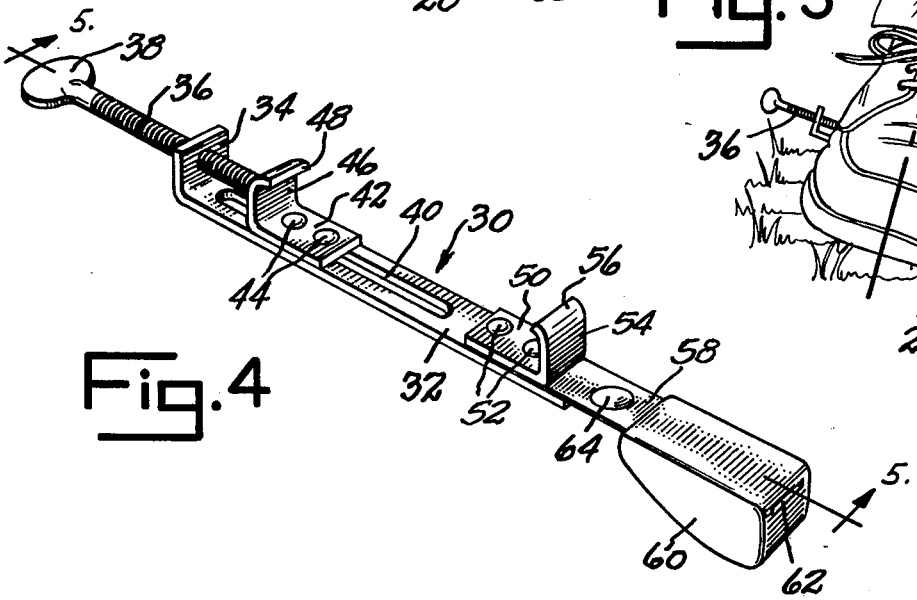
FIG. 4 is a perspective view of one embodiment of the device.
Figure 5:
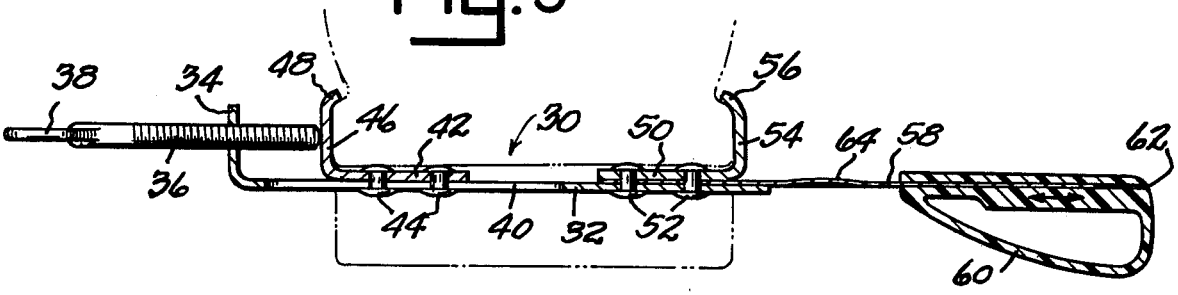
FIG. 5 is a longitudinal sectional view taken on line 5—5 of FIG. 4.

An elongated spring plate 58 is fixedly secured to the base plate 32 and extends longitudinally or endwise therefrom beyond the fixed clamp 50–56, and preferably is positioned between the base plate 32 and the fixed clamp 56 and is anchored thereto by the securing means 52. At its outer end the elongated spring plate mounts an abutment member 60 which projects therefrom or therebelow in a direction opposite the direction from which the clamps 46 and 54 project from the base, that is, which projects downwardly from the member 58 when the device is attached to a shoe as illustrated in FIGS. 2, 3 and 6. The member 60 may be of any suitable construction and preferably is adjustable lengthwise upon the spring plate 58. As illustrated in FIGS. 4 and 5, the abutment member 60 may be provided with a longitudinal guide passage 62 having a snug frictional fit upon the end of the spring plate 58 and accommodating adjustment of the abutment member 60 to selected spaced relation to the base plate 32 and the fixed clamp 54. The elongated spring plate 58 is provided with a deformed part 64 spaced from the fixed clamp 54 and the base 32 and also preferably spaced from the abutment member 60. The deformed part 64 is preferably positioned between or inset from the side edges of the spring plate 58 and is preferably concavo-convex in shape and of a character of the type commonly known as a "cricket" which responds to a predetermined small degree of flexure of the spring plate by producing an audible sound.

The device is mounted upon a shoe of a user who is preparing to practice his stroke in such a position that the parts 58, 60 thereof project to the left from the left foot of the right handed golfer or which project to the right from the right foot of a left handed golfer. The base plate 32 and spring plate 58 of the device are clear of the floor or other supporting surface and the abutment member 60 projects downwardly and preferably touches the floor or other supporting surface at a point spaced laterally from the shoe and only slightly, if at all, deflects the spring plate 58 during normal stance of the user, i.e. during the stance of the user at the beginning of a stroke. As the stroke of a right handed golfer is completed and his weight shifts to his left foot to an extent which characterizes a full and effective stroke or swing the left foot to which the device is secured tends to tilt laterally, as from the FIG. 2 position to the FIG. 3 position. When the stroke has been proper or as desired, the lateral tilt of the shoe is sufficient to flex the resilient member 58 to an extent to cause the deformed or off-set part 64 to cause a noise or audible signal to be produced. Thus, if the wearer in making a stroke does not hear a sound or signal produced by the spring plate 58, 64, he is aware that the follow-through of his stroke has not been characterized by a shifting or transfer of the weight of his body incident to the stroke as required for a proper or desired stroke. Conversely, when a spring-flexure sound is heard, the user is advised or signalled that his stroke has had a proper follow-through and weight transfer. Thus, each stroke is evaluated and the user immediately is aware of the adequacy or inadequacy of the weight transfer incident to the follow-through. It will be apparent that repetition of strokes in which the desired audible signal is heard following each stroke assure the user that he is perfecting, standardizing or "grooving" his strokes.

The adjustable mounting of the abutment member 60 accommodates the setting of the abutment member and its spacing laterally from the shoe of the wearer to the optimum position to accommodate the physical attributes of the user. The device may be provided with indicia (not shown) upon the spring plate 58 by which the user can determine the position of abutment member 60 best adapted for his usage.

Figure 7:
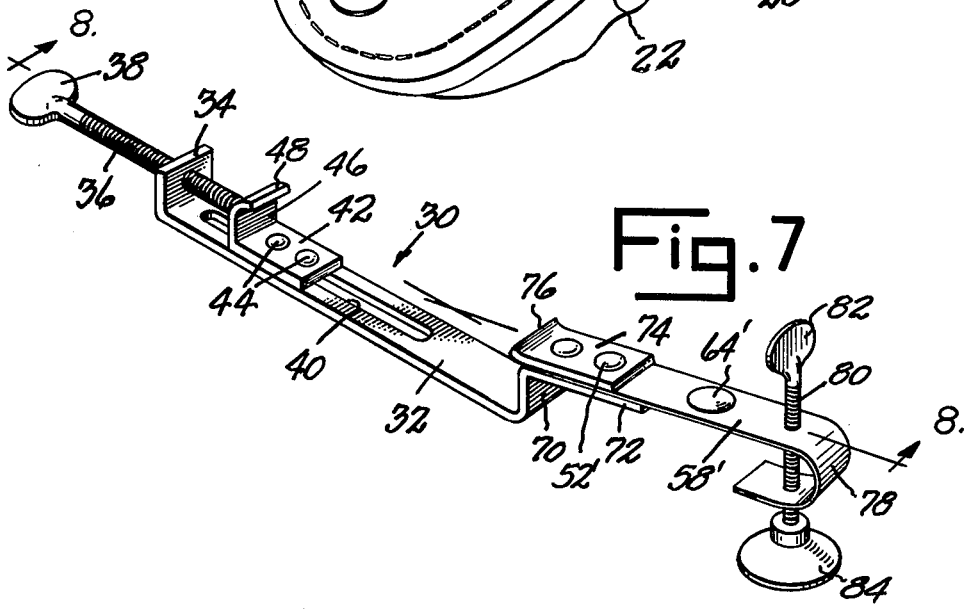
FIG. 7 is a perspective view of a modified embodiment of the invention.
Figure 8:
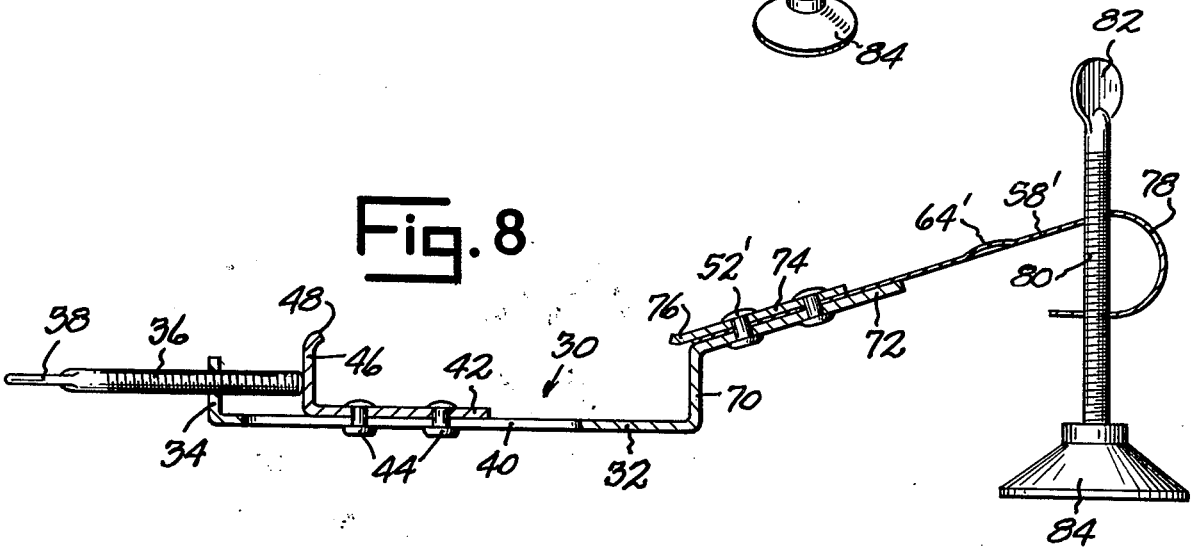
FIG. 8 is a longitudinal sectional view taken on line 8 of FIG. 7.

In the embodiment of the invention illustrated in FIGS. 7 and 8, parts similar to those shown in FIGS. 6 and 7 bear the same reference numerals. In this construction, the base plate 32 is longer than that in the previously described embodiment and includes an upwardly off set portion 70 and an angularly outwardly projecting end portion 72. A plate 74 is secured to plate portion 72 by securing members 52' and projects inwardly from the part 70 at 76 to engage the shoe sole and co-operate with clamp part 46–48 to anchor the device to the shoe sole at the instep in the same position illustrated in FIG. 6. The elongated spring plate 58' is anchored to the base plate portion 72 by the securing members 52' and is characterized by the deformed or "cricket" portion 64' spaced outwardly from the end of the base plate portion 72. The terminal portion of the spring plate 58' is return bent at 78 and spaced portions of the spring plate are provided with apertures in which is threaded an adjusting screw 80 having a hand grip 82 at its upper end and mounting an enlarged foot portion 84 at its lower end. It will be seen that this device functions similarly to the device illustrated in FIG. 1 with anchorage of the device to the shoe in the same manner as above described effective through tightening of the screw 36 and with the foot portion 84 adapted to contact the earth or floor in such a manner as to produce flexure of the spring member and result in production of a signalling sound open predetermined lateral tilting of the shoe as occurs in a desired follow-through of the swing or stroke.

In the embodiment of the invention illustrated in FIGS. 9–13 is illustrated a two-part clamp construction in which one elongated clamp part 90 mounts a rigid upwardly projecting hook portion 92 for engagement with the sole of a shoe at the instep and the elongated body of the clamp is provided with a plurality or longitudinal set of spaced notches 94. The other part 96 of the clamp has a longitudinal groove which is laterally notched at 98 and is adapted to receive and anchor notched clamp part 90–94 in selected longitudinal adjustment. Clamp part 96 preferably includes spaced upwardly projecting portions 100 which terminate in hooks 102 adapted to cooperate with the hook 92 to anchor the device to the sole of a shoe in the position illustrated in FIG. 6. Projections 100 may include spaced ribs 104 at their inner faces between which are mounted and secured the side margins of the inner end of an elongated spring member 106 upon which is adjustably mounted a ground abutment member 108 and which is provided with a deformed spring part or "cricket" 110 preferably located between the mounting ribs 104 and the abutment member 108.

All embodiments of the invention have the same characteristics of attachable and adjustable mounting upon a shoe, and a deformed part of the spring plate such as a "cricket" which produces an audible signal incident to lateral tilting of the shoe on which the device is supported during a proper followthrough of a golf stroke. It is not essential that the device be clamped to the sole of a shoe at the instep, and any arrangement by which the device is firmly secured to a shoe, as by means of a strap, with a spring plate projecting laterally from the shoe and of a nature to produce an audible signal when it is flexed will serve the intended function.

Other embodiments of the invention are contemplated which fall within the scope of the appended claims.

What I claim is:

1. A golf training device comprising an elongated base, means for securing said base to the instep portion of a shoe to extend transversely of the shoe, an elongated spring plate projecting from said base longitudinally of said base, and laterally outwardly from the shoe, and an abutment part at the outer end of said spring plate spaced from the base and from the shoe for engagement with a surface on which a wearer of the shoe stands when the shoe tilts sidewise relative to said surface in the direction in which said spring plate extends, said spring plate including a deformed portion between said base and said abutment, said plate being adapted to produce a sound only incident to a predetermined extent of flexure of said spring plate during change of the lateral angular tilted position of the shoe incident of shifting of the wearer's weight during a golf stroke.

2. A golf training device as defined in claim 1, wherein said securing means includes a sole-engaging clamp fixed on said base and a sole-engaging clamp adjustable on said base and means for selectively positioning said adjustable clamp.

3. A golf training device as defined in claim 1, wherein said abutment member is longitudinally adjustably positioned on said spring plate.

4. A golf training device as defined in claim 1, wherein said securing means includes a fixed clamp member secured by said base and said spring is anchored at one end thereof between said base and clamp by securing means connecting said base and clamp.

5. A golf training device as defined in claim 1, wherein said base has an elongated guide portion, said securing means includes a clamp slidable on said base along said guide portion, and means carried by said base for urging said slidable clamp to clamping position.

6. A golf training device as defined in claim 1, wherein said deformed portion is positioned in spaced relation to the side edges of said spring plate.

7. A golf training device as defined in claim 1, wherein said deformed portion is substantially concavo-convex and spaced from the side edges of the spring plate.

* * * * *